US005685139A

United States Patent [19]

Mick et al.

[11] Patent Number: 5,685,139

[45] Date of Patent: Nov. 11, 1997

[54] DIFFUSION-PREMIX NOZZLE FOR A GAS TURBINE COMBUSTOR AND RELATED METHOD

[75] Inventors: Warren J. Mick, Altamont; L. Berkley Davis, Jr., Niskayuna; Michael B. Sciocchetti, Schenectady; David O. Fitts, Ballston Spa, all of N.Y.

[73] Assignee: General Electric Company, Schenectady, N.Y.

[21] Appl. No.: 648,802

[22] Filed: Mar. 29, 1996

[51] Int. Cl.[6] ..... F02L 7/26; F02G 3/00

[52] U.S. Cl. ..... 60/39.06; 60/39.091; 60/39.11; 60/737; 60/742; 239/428

[58] Field of Search ..... 60/39.06, 39.091, 60/39.11, 39.1, 732, 733, 737, 738, 742, 746, 747, 748, 740; 239/124, 428, 433

[56] References Cited

U.S. PATENT DOCUMENTS 4,292,801 10/1981 Wilkes et al. .
4,850,196 7/1989 Scalzo et al. ..... 60/740
4,982,570 1/1991 Waslo et al. .
5,259,184 11/1993 Borkowicz et al. .
5,274,991 1/1994 Fitts .
5,408,830 4/1995 Lovett ..... 60/737

*Primary Examiner*—Charles G. Freay
*Attorney, Agent, or Firm*—Nixon & Vanderhye

[57] ABSTRACT

A fuel nozzle for a gas turbine includes a nozzle body having a tip portion, the nozzle body including an inner tube defining an axially extending air passage; an intermediate tube concentrically arranged and radially spaced from the inner tube and defining a diffusion fuel passage therebetween; and an outer tube concentrically arranged and radially spaced from the intermediate tube and defining a premix fuel passage therebetween. The outer tube has a plurality of radially extending injectors in communication with the premix fuel passage. The premix fuel passage is further defined in part by an outer tube wall portion formed with at least one weakened region adapted to burn through in the event of a flashback, thereby causing a substantial portion of premix fuel to bypass the injectors and to exit the nozzle body at the at least one weakened region. A related method is also disclosed.

16 Claims, 5 Drawing Sheets

DIFFUSION-PREMIX NOZZLE FOR A GAS TURBINE COMBUSTOR AND RELATED METHOD

TECHNICAL FIELD

This invention relates to gas turbine combustion systems and, specifically, to a new fuel nozzle design which is intended to minimize combustor damage in the event of combustion flame flashback.

BACKGROUND PRIOR ART

A gas turbine combustor is essentially a device used for mixing large quantities of fuel and air, and burning the resulting mixture. Typically, the gas turbine compressor pressurizes inlet air which is then turned in direction or reverse flowed to the combustor where it is used to cool the combustor and also to provide air to the combustion process. The assignee of this invention utilizes multiple combustion chamber assemblies in its heavy duty gas turbines to achieve reliable and efficient turbine operation. Each combustion chamber assembly comprises a cylindrical combustor, a fuel injection system, and a transition piece that guides the flow of the hot gas from the combustor to the inlet of the turbine section. Gas turbines for which the present fuel nozzle design is to be utilized may include six, ten, fourteen, or eighteen combustors arranged in a circular array about the turbine rotor axis.

In an effort to reduce the amount of $NO_x$ in the exhaust gas of the gas turbine, dual stage, dual mode combustors have been developed which include two combustion chambers in each combustor, such that under conditions of normal operating load, the upstream or primary combustion chamber serves as a premix chamber, with actual combustion occurring at a downstream or secondary combustion chamber. Under normal operating conditions, there is no flame in the primary chamber (resulting in a decrease in the formation of $NO_x$), and a secondary or center nozzle provides the flame source for combustion in the secondary chamber. This specific configuration includes an annular array of primary nozzles within each combustor, each of which nozzles discharges into the primary combustion chamber, and a central secondary nozzle which discharges into the secondary combustion chamber. These nozzles are diffusion nozzles in which each nozzle is of an axial fuel delivery type surrounded at its discharge end by an air swirler as described in commonly owned U.S. Pat. No. 4,292,801.

Commonly owned U.S. Pat. No. 4,982,570 discloses a dual stage, dual mode combustor which utilizes a combined diffusion/premix nozzle as the centrally located secondary nozzle. In operation, a relatively small amount of fuel is used to sustain a diffusion pilot whereas a premix section of the nozzle provides additional fuel for ignition of the main fuel supply from the primary nozzles directed into the primary combustion chamber.

U.S. Pat. No. 5,259,184 discloses a single stage, dual mode combustor capable of operation on both gaseous and liquid fuel. On gas, the combustor operates in a diffusion mode at low loads (less than 50% load), and a premix mode at high loads (greater than 50% load). While the combustor is capable of operating in the diffusion mode across the load range, diluent injection is required for $NO_x$ abatement. Oil operation on this combustor is in the diffusion mode across the entire load range, with diluent injection used for $No_x$ abatement.

In order to operate gas turbines at very low $NO_x$ emission levels without diluent injection while burning gas fuel, a combustible mixture of the fuel and air is created in a zone of the combustor away from the zone where the burning occurs. Typically, the premixing zone is not designed to endure the high temperatures encountered in the burning zone. Unfortunately, it is possible for the combustor to be unintentionally operated so as to cause the flame to "flashback" from the burning zone into the premixing zone, which can result in serious damage to combustor components from burning, as well as damage to the hot gas path of the turbine when burned combustor pads are liberated and passed through the turbine section.

There are limited ways to prevent flashback damage from occurring, e.g., design a flashback proof combustor, or design a flashback tolerant combustor. The assignee's initial dry low $NO_x$ combustor (as disclosed in U.S. Pat. No. 4,292,801), falls into the flashback-tolerant category of combustors. In the event of a flashback into the premixing region, flame detectors monitoring the premixing zone provide an indication of flame, and the controlled logic signals to the sparkplug to fire, thus transferring the combustor from premixed load into lean-lean mode. No damage is done to the combustor, but the $NO_x$ emissions levels from the combustor exceed guaranteed levels. This type of flashback sensing is not practical, however, with the later dry low $NO_x$ combustor (as disclosed in U.S. Pat. No. 5,274,991) with its five non-connected premixing zones per combustion chamber.

SUMMARY OF THE INVENTION

It is the principal objective of this invention to provide a "fuse" arrangement in each combustor fuel nozzle in a single stage, dual mode combustor, so that in the event of a flashback into any one or more of the many premixing zones (70 or 90 in current gas turbine models), the damage to the combustor will be controlled to a minimum, such that no significant damage to the turbine section itself is suffered. The other principal objective, also in the event of flashback, is to shut down the gas turbine without the need for a machine trip. A final objective is to provide for flashback protection without a major redesign of existing combustor hardware.

To these ends, the present invention involves placing a number of sacrificial "plugs" or "fuses" in the side wall of each diffusion/premix fuel nozzle which will either melt or burn through significantly faster than any other portion of the premixing zone of the combustor. This is accomplished by constructing the plugs or fuses from a low melting temperature alloy; making the plug region with a thinned wall thickness which will heat rapidly; or constructing the plugs using a combination of both features, i.e., low melting point and thin material. When the plugs or fuses melt or burn away, the fuel gas vents through the newly formed opening or openings, thus lowering the fuel gas pressure inside the fuel nozzle. At the same time, a substantial portion of the premix fuel will no longer pass through the premixing nozzle orifices and the result will be a premixing zone which is too lean to support combustion, and the flashback flame will be extinguished. The turbine combustor will then operate in a diffusion only mode, at lesser efficiency, until repairs can be made.

In accordance with its broader aspects, therefore, the present invention relates to a fuel nozzle for a gas turbine comprising a nozzle body having a tip portion, the nozzle body including an inner tube defining an axially extending air passage; an intermediate tube concentrically arranged and radially spaced from the inner tube and defining a diffusion fuel passage therebetween; and an outer tube concentrically arranged and radially spaced from the intermediate tube and defining a premix fuel passage therebetween; the outer tube having a plurality of radially extending injectors in communication with the premix fuel passage; and wherein the premix fuel passage is further defined in part by an outer tube wall portion formed with at least one weakened region adapted to burn through in the event of a flashback, thereby causing a portion of premix fuel to bypass the injectors and to exit the nozzle body at the at least one weakened region.

In accordance with another aspect, the invention relates to a gas turbine, a plurality of combustors, each having a plurality of fuel nozzles arranged about a longitudinal axis of the combustor, and a combustion zone, each fuel nozzle having a diffusion gas passage connected to a diffusion gas inlet and a premix gas passage connected to a premix gas inlet, the premix gas passage communicating with a plurality of premix fuel injectors extending radially away from the premix gas passage, and located within a dedicated premix tube adapted to mix premix fuel and combustion air prior to entry into the combustion zone located downstream of the premix tube, and wherein the diffusion gas passage terminates at a forward discharge end of the fuel nozzle downstream of the premix fuel but within the dedicated premix tube, and wherein the plurality of premix fuel injectors are located upstream of the forward end; and further wherein the diffusion gas passage is defined in part by a forward wall portion of the fuel nozzle body, the forward wall portion formed with a circumferential array of regions of lesser wall thickness than remaining regions of the forward wall portion.

In still another aspect, the invention relates to a method of minimizing flashback damage in a gas turbine combustor which includes a plurality of combustors, each of which includes a premix zone, a combustion zone and a plurality of nozzles, each nozzle having a diffusion gas passage connected to a diffusion gas inlet and a premix gas passage connected to a premix gas inlet, the premix gas passage communicating with a plurality of premix fuel injectors extending radially away from the premix gas passage, and located within a dedicated premix tube adapted to mix premix fuel and combustion air prior to entry into the single combustion zone located downstream of the premix tube, and wherein the diffusion gas passage terminates at a forward discharge end of the fuel nozzle downstream of the premix fuel injectors but within the dedicated premix tube, and wherein the premix fuel injectors are located upstream of the forward end; and further wherein the diffusion gas passage is defined in part by a forward wall portion of the fuel nozzle body, the method including the step of providing weakened regions in a wall partially defining the premix passage, downstream of the premix fuel injectors so that, in the event of a flashback of flame into the premix zone, the weakened regions will burn through, allowing a substantial portion of premix fuel to bypass the premix fuel injectors, such that any premix fuel exiting the injectors is insufficient to sustain a flame.

Other objects and advantages of the subject invention will become apparent from the detailed description which follows.

BEST MODE FOR CARRYING OUT THE INVENTION

Figure 1:
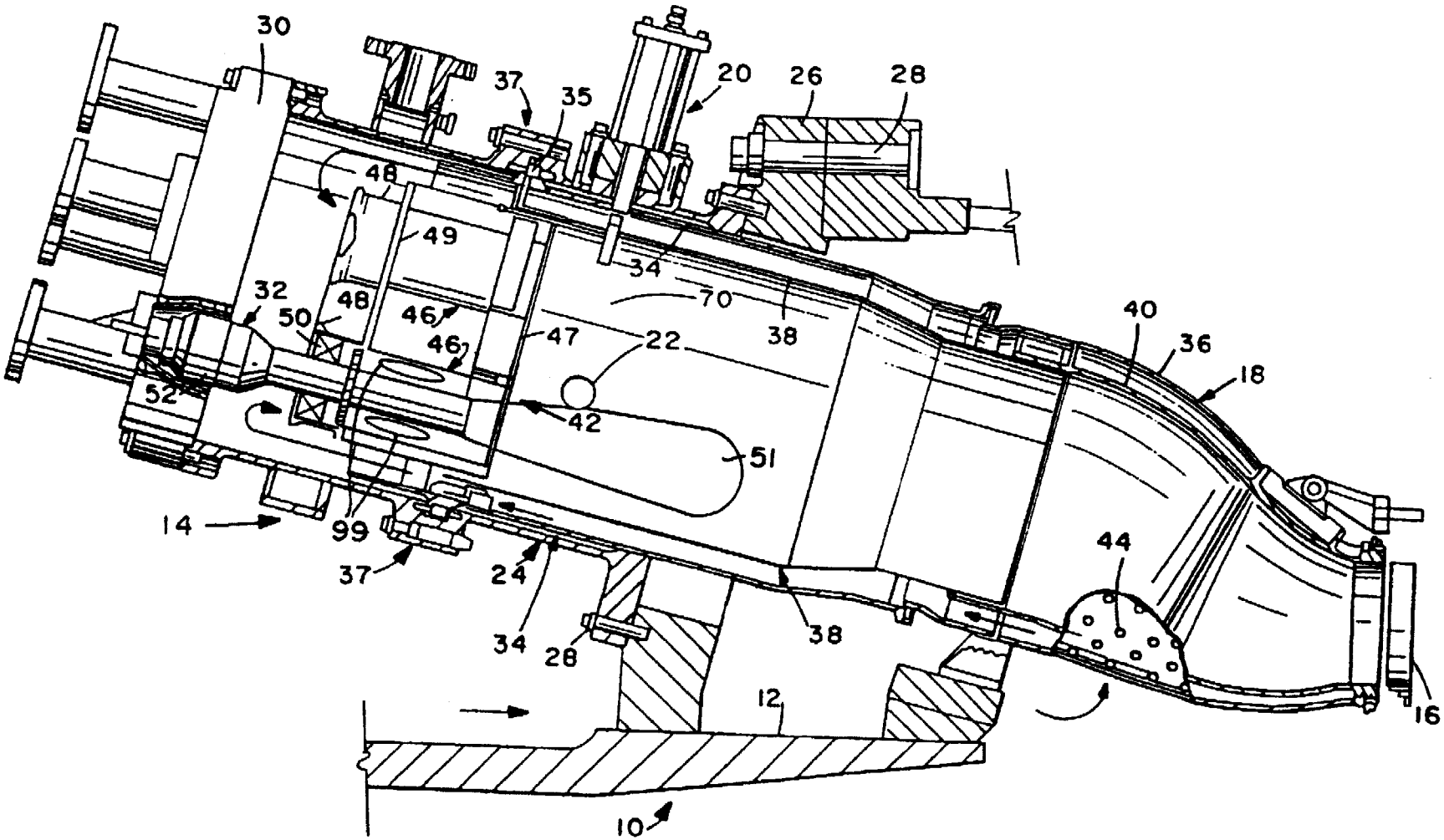
Fig. 1 (Prior Art)
FIG. 1 is a partial cross section of a known gas turbine combustor.

With reference to FIG. 1, a known gas turbine construction 10 includes a compressor casing 12 (partially shown), a plurality of combustors 14 (one shown), and a turbine section represented here by a single turbine blade 16. Although not specifically shown, the turbine blading is drivingly connected to a compressor rotor along a common axis. The compressor pressurizes inlet air which is then reverse flowed (as shown by the flow arrows) to the combustor 14 where it is used to cool the combustor and to provide air to the combustion process.

As noted above, the gas turbine includes a plurality of combustors 14 located in a circular array within the gas turbine. A double-walled transition duct 18 connects the outlet end of each combustor with the inlet end of the turbine section to deliver the hot gaseous products of combustion to the turbine section.

Ignition is achieved in the various combustors 14 by means of spark plug 20 in conjunction with cross fire tubes 22 (one shown) connecting the combustors in the usual manner.

Each combustor 14 includes a substantially cylindrical combustion casing 24 which is secured at an open forward end to the turbine casing 26 by means of bolts 28. The rearward end of the combustion casing is closed by an end cover or cap assembly 30 which may include conventional supply tubes, manifolds and associated valves, etc. for feeding gas, liquid fuel and air (and water if desired)to the combustor. The end cover assembly 30 receives a plurality (for example, five) of diffusion/premix fuel nozzle assemblies 32 (only one shown for purposes of convenience and clarity) arranged in a circular array about a longitudinal axis of the combustor.

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42 which is, in turn, supported within the combustor casing as described in U.S. Pat. No. 5,274,991. It will be appreciated that the outer wall 36 of the transition duct 18, as well as that portion of flow sleeve 34 extending forward of the location where the combustion casing 24 is bolted to the turbine casing (by bolts 28) are formed with an array of apertures 44 over their respective peripheral surfaces to permit air to reverse flow from the compressor through the apertures 44 into the annular space between the flow sleeve 34 and the liner 38 toward the upstream or rearward end of the combustor (as indicated by the flow arrows shown in FIG. 1).

The combustion liner cap assembly 42 supports a plurality of premix tubes 46, one for each fuel nozzle assembly 32. More specifically, each premix tube 46 is supported within the combustion liner cap assembly 42 at its forward and rearward ends by front and rear plates 47, 49, respectively, each provided with openings aligned with the open-ended premix tubes 46. The front plate 47 (an impingement plate provided with an array of cooling apertures) may be shielded from the thermal radiation of the combustor flame by shield plates (not shown) as also described in the '991 patent.

The rear plate 49 mounts a plurality of rearwardly extending floating collars 48, one for each premix tube 46. The arrangement is such that air flowing in the annular space between the liner 38 and flow sleeve 34 is forced to again reverse direction in the rearward end of the combustor (between the end cap assembly 30 and combustion liner cap assembly 42) and to flow through swirlers 50 and premix tubes 46 before entering the burning or combustion zone 51 within the liner 38, downstream of the premix tubes 46. As noted above, the construction details of the combustion liner cap assembly 42, the manner in which the liner cap assembly is supported within the combustion casing, and the manner in which the premix tubes 46 are supported in the liner cap assembly are described in more detail in the '991 patent, incorporated herein by reference.

Figure 2:
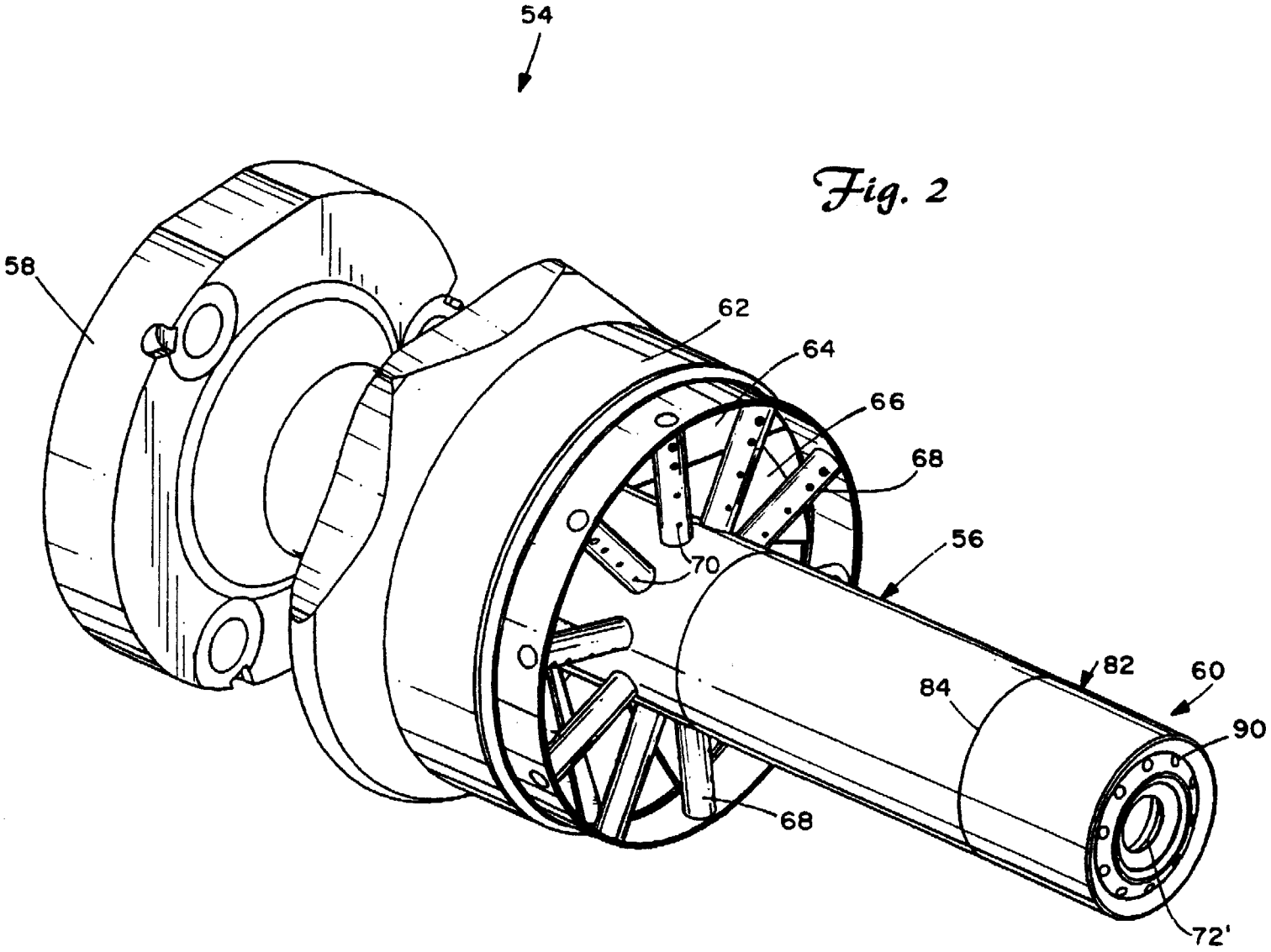
FIG. 2 is a perspective view of a nozzle for use in the combustor of FIG. 1, in accordance with an exemplary embodiment of the invention.

Turning to FIG. 2, a diffusion/premix fuel nozzle assembly 54 in accordance with this invention is shown which is intended to replace the nozzle assembly 32 shown in FIG. 1. The nozzle assembly 54 includes a nozzle body 56 connected to a rearward supply section 58, and a forward fuel/air delivery section 60. The nozzle assembly includes a collar 62 which defines an annular passage 64 between the collar 62 and the nozzle body 56. Within this annular passage is an air swirler 66 (similar to swirler 50 in FIG. 1), upstream of a plurality of radial fuel injectors 68, each of which is formed with a plurality of discharge orifices 70 for discharging premix gas into passage 64 within the premix region (within the premix tube 46).

Figure 3:
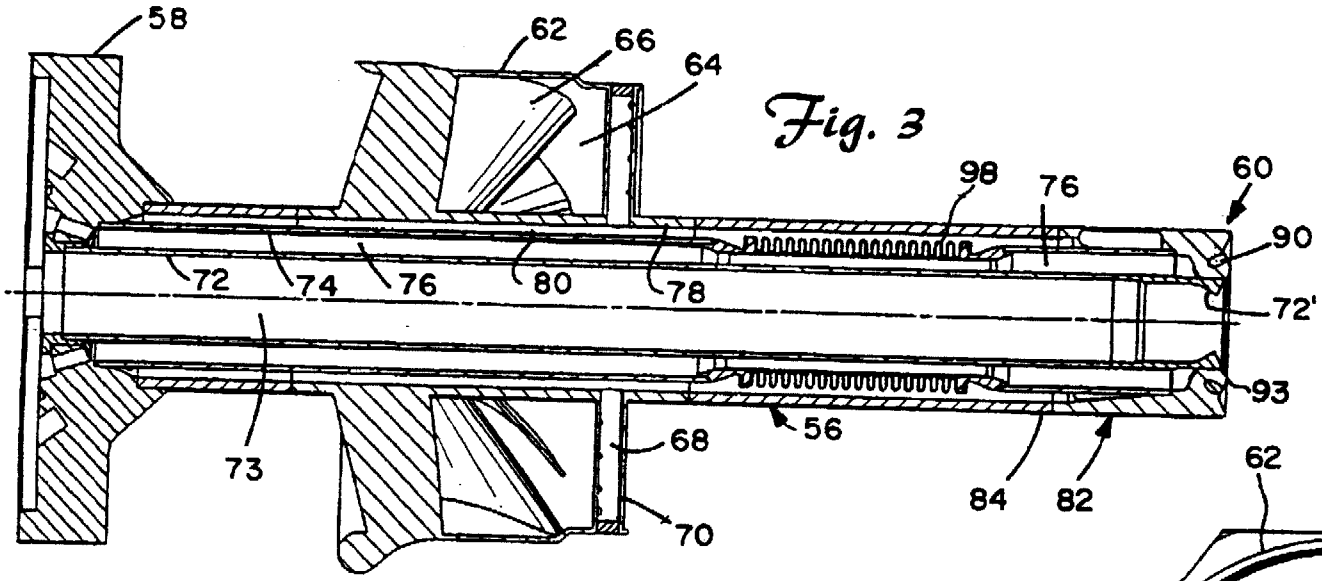
FIG. 3 is a cross section of the nozzle shown in FIG. 2.
Figure 4:
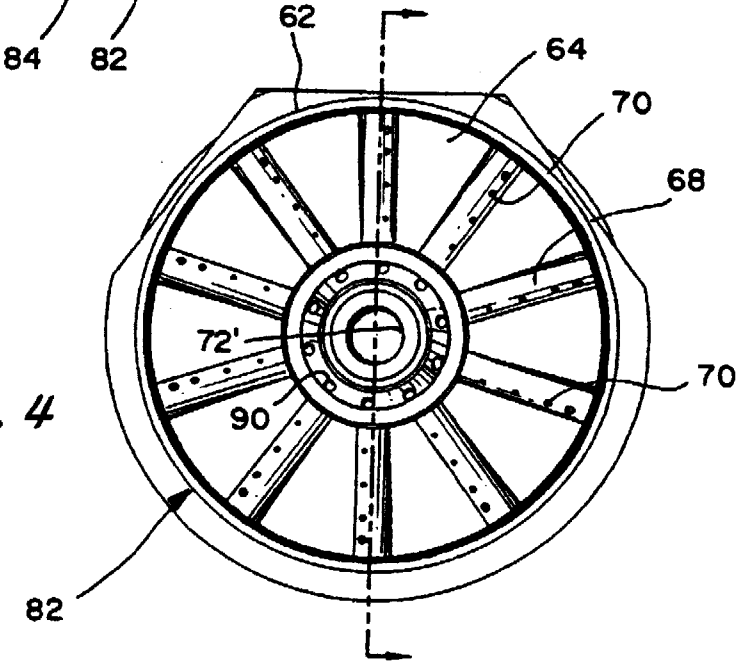
FIG. 4 is a front elevation of the nozzle shown in FIG. 2 but with parts removed for clarity.

With reference also to FIGS. 3 and 4, the nozzle body interior includes a centrally located (radially inner) atomized air tube 72 which feeds air to the combustion zone via internal passage 73. A radially intermediate tube 74 of larger diameter than tube 72, is oriented concentrically with the tube 72 to create an annular diffusion gas passage 76. A radially outer tube 78 surrounds the tube 74, defining a radially outermost passage 80 for carrying premix fuel gas to the premix zone as described below. The passage 80 is closed at the forward tip of the nozzle, forcing the premix gas to exit the discharge orifices 70 in the radial injectors 68 and into the premix zone within premix tube 46.

The nozzle tip 82 which incorporates the subject invention is best seen in FIGS. 5–8. The tip 82 is sized to engage the nozzle body 56 and to be welded thereto at 84 (see FIG. 2). The tip is formed with an interior, annular shoulder 86 which receives the forward edge of tube 74, and which is welded or brazed at this forward edge. It is also here that the forward end of the diffusion gas passage 80 is closed (see FIG. 3).

The tip 82 is also formed with a center opening defined by bore 88 which receives the forward end of inner tube 72 in press fit engagement. The tube 72 has a reduced diameter discharge opening at its forward end, defining the combustion orifice 72'. A plurality of discharge orifices or passages 90 extend through the forward wall of the tip and communicate with the diffusion gas passage 76. The orifices or passages 90 are angled as best seen in FIG. 8 to swirl the diffuser gas as it exits the nozzle body into the burning zone combustion chamber.

Figure 5:
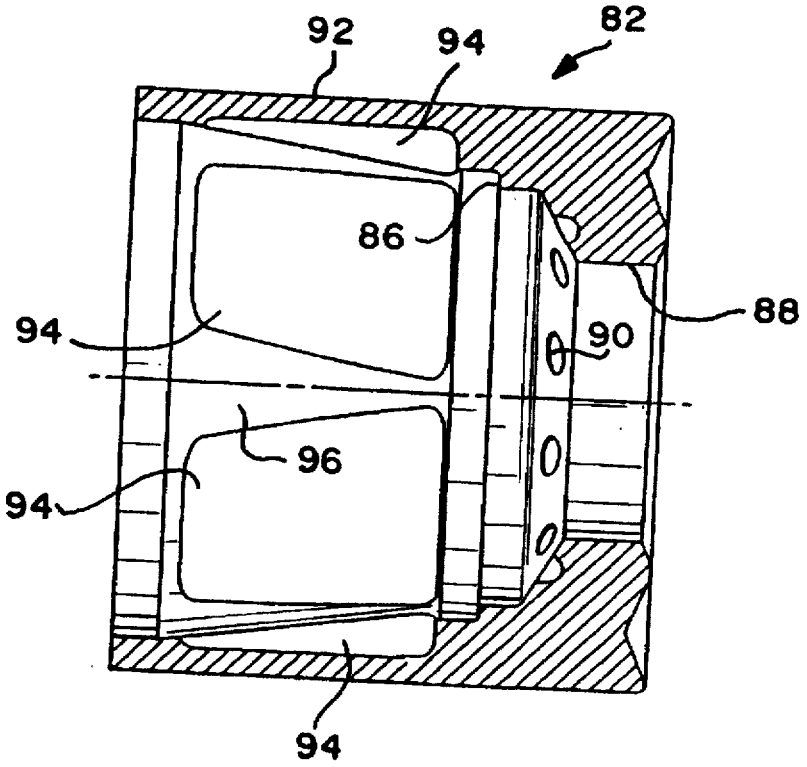
FIG. 5 is a cross section of the tip portion of the nozzle shown in FIG. 2.
Figure 6:
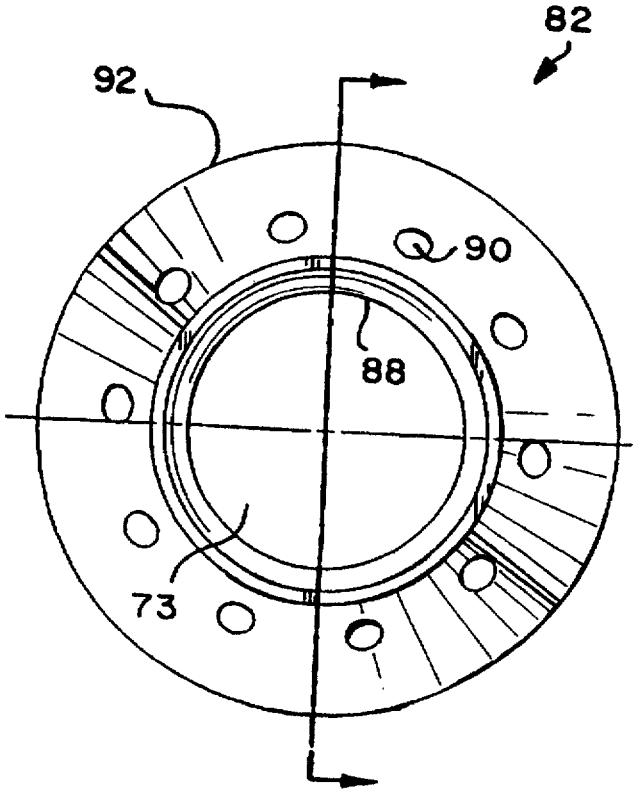
FIG. 6 is a front elevation of the tip portion of FIG. 5.
Figure 7:
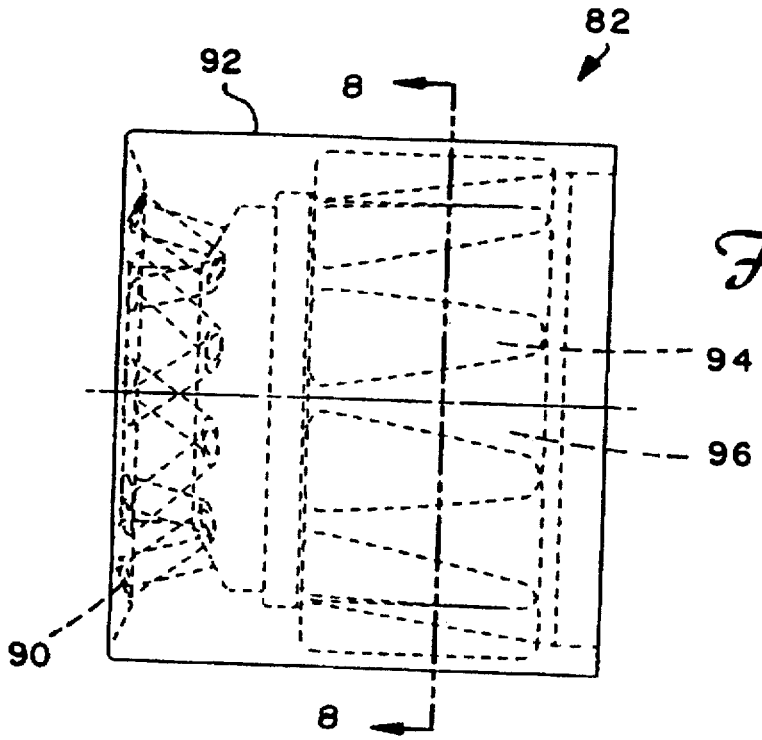
FIG. 7 is a side elevation of the tip portion of FIGS. 5 and 6.
Figure 8:
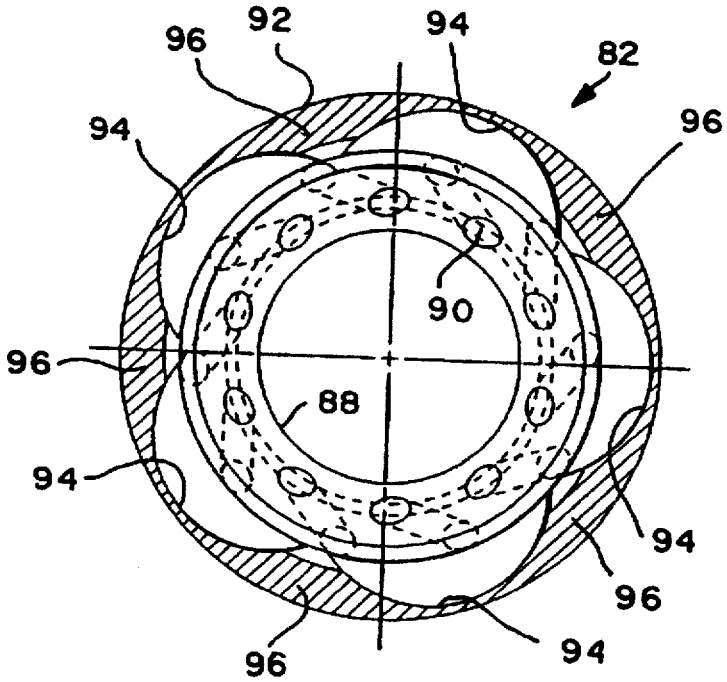
FIG. 8 is a section taken through the line 8—8 of FIG. 7.

In accordance with this invention, the wall thickness of the tip 82 along the longitudinally oriented cylindrical wall 92, which forms the forward part of the premix fuel passage 80, is thinned, i.e., undercut, at a plurality of shaped regions 94, spaced circumferentially about the wall in a pattern best seen in FIGS. 5, 7 and 8. These plug or fuse regions 94 are separated by thicker web portions 96.

With the tip welded to the nozzle body as shown in FIG. 3, it can be seen that the air, diffusion gas and premix gas passages 73, 76 and 80, respectively, are continued in the tip, with atomized air exiting the center opening 72', diffusion gas exiting the circular array of apertures 90, and premix gas forced to exit orifices 70 of the upstream radial injectors 68.

With reference back to FIG. 3, another feature of the invention is the provision of an integral bellows portion 98 in the intermediate tube 74 which permits differential thermal growth between the otherwise rigidly fixed tubes 74 and 78. No similar arrangement is required in the inner tube 72 since the latter is only clearance fit at 93 in the nozzle tip 82 to provide for differential motion therebetween.

In the event of a combustion flashback into the premix zone, one or more (or all) of the fuse regions 94 will burn through due to the higher temperature being experienced at the fuse regions 94 whereby the flame attaches at the radial fuel injectors 68 (see FIG. 1), allowing the premix gas to substantially bypass the radial injectors 68, and exit directly into the combustion zone through the burned out plugs or fuses. What little premix gas continues to flow out of the radial injectors 68 is insufficient to sustain a flame, thereby causing the flashback to terminate.

Any molten metal released into the combustor by reason of the rupturing fuse regions will be substantially vaporized in the combustion chamber, and do not pose any threat of further damage to the combustor. Simultaneously, the combustor switches over from a premix burning mode to a diffusion burning mode until repairs can be effected. While the turbine will now operate at lesser emissions efficiency, it will nevertheless operate satisfactorily, with minimum damage to the combustor and no damage to the turbine itself.

It will be appreciated that the plug or fuse regions 94 may also be formed by discrete plugs made of a low temperature alloy, of the same or lesser thickness than surrounding portions of the tip, and welded in place within openings formed in the tip 82.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle for a gas turbine comprising:

a nozzle body having a tip portion, said nozzle body including an inner tube defining an axially extending air passage;

an intermediate tube concentrically arranged and radially spaced from said inner tube and defining a diffusion fuel passage therebetween; and an outer tube concentrically arranged and radially spaced from said intermediate tube and defining a premix fuel passage therebetween; said outer tube having a plurality of radially extending injectors in communication with said premix fuel passage; and wherein said premix fuel passage is further defined in part by an outer tube wall portion formed with at least one weakened region adapted to burn through in the event of a flashback, thereby causing a portion of premix fuel to bypass said injectors and to exit the nozzle body at said at least one weakened region.

2. The fuel nozzle of claim 1 wherein a plurality of weakened regions including said at least one region are located in an annular array within said outer tube wall.

3. The fuel nozzle of claim 2 wherein said weakened regions are formed by reduced wall thickness.

4. The fuel nozzle of claim 1 wherein said at least one weakened wall region is formed in said tip portion.

5. The fuel nozzle of claim 4 wherein said tip portion is rigidly fixed to said intermediate and outer tubes.

6. The fuel nozzle of claim 5 wherein said intermediate tube incorporates a bellows portion to accommodate differential thermal expansion relative to said outer tube.

7. The fuel nozzle of claim 6 wherein said inner tube is clearance fit into said fuel nozzle tip portion.

8. The fuel nozzle of claim 1 wherein premix passage is normally closed downstream of said plurality of injectors.

9. The fuel nozzle of claim 4 wherein said tip portion includes a plurality of discharge orifices in communication with said diffusion fuel passage.

10. In a gas turbine, a plurality of combustors, each having a plurality of fuel nozzles arranged about a longitudinal axis of the combustor, and a combustion zone, each fuel nozzle having a diffusion gas passage connected to a diffusion gas inlet and a premix gas passage connected to a premix gas inlet, the premix gas passage communicating with a plurality of premix fuel injectors extending radially away from said premix gas passage, and located within a dedicated premix tube adapted to mix premix fuel and combustion air prior to entry into the combustion zone located downstream of the premix tube, and wherein said diffusion gas passage terminates at a forward discharge end of said fuel nozzle downstream of said premix fuel injectors but within said dedicated premix tube, and wherein said plurality of premix fuel injectors are located upstream of said forward end; and further wherein said diffusion gas passage is defined in part by a forward wall portion of the fuel nozzle, said forward wall portion formed with a circumferential array of regions of lesser wall thickness than remaining regions of said forward wall portion.

11. The fuel nozzle of claim 10 wherein said forward wall portion is provided with a plurality of annularly arranged discharge orifices in communication with said diffusion fuel passage.

12. The fuel nozzle of claim 10 wherein an intermediate tube defining the diffusion and premix gas passages incorporates a bellows portion to accommodate differential thermal expansion relative to said dedicated premix tube.

13. The fuel nozzle of claim 12 wherein an inner tube is press fit into said forward discharge end of said nozzle.

14. The fuel nozzle of claim 10 wherein said premix passage is normally closed downstream of said plurality of injectors.

15. A method of minimizing flashback damage in a gas turbine combustor which includes a plurality of combustors, each of which includes a premix zone, a combustion zone and a plurality of nozzles, each nozzle having a diffusion gas passage connected to a diffusion gas inlet and a premix gas passage connected to a premix gas inlet, the premix gas passage communicating with a plurality of premix fuel injectors extending radially away from said premix gas passage, and located within a dedicated premix tube adapted to mix premix fuel and combustion air prior to entry into the single combustion zone located downstream of the premix tube, and wherein said diffusion gas passage terminates at a forward discharge end of said fuel nozzle downstream of said premix fuel injectors but within said dedicated premix tube, and wherein said premix fuel injectors are located upstream of said forward end; and further wherein said diffusion gas passage is defined in part by a forward wall portion of the fuel nozzle, the method including the step of providing weakened regions in a wall partially defining said premix passage so that, in the event of a flashback of flame into the premix zone, said weakened regions will burn through, allowing a substantial portion of premix fuel to bypass said premix fuel injectors, such that any premix fuel exiting said injectors is insufficient to sustain a flame.

16. In a fuel nozzle for a gas turbine combustor having a nozzle body defining a fuel-air passage and an injector in fluid communication with said passage for injecting a fuel-air mixture from said passage into a burning zone, the improvement comprising a weakened region of the nozzle body adapted to burn through in the event of combustion flashback, thereby permitting a portion of said fuel-air mixture to bypass said injector and to exit said nozzle body at said weakened region.

* * * * *